United States Patent [19]

Chapman

[11] Patent Number: 4,491,239

[45] Date of Patent: Jan. 1, 1985

[54] PIVOTAL CONSTRUCTION FOR PORTABLE COOLER

[75] Inventor: Jacque W. Chapman, Gales Feery, Conn.

[73] Assignee: King-Seeley Thermos Co., Prospects Heights, Ill.

[21] Appl. No.: 529,497

[22] Filed: Sep. 6, 1983

[51] Int. Cl.[3] ..... B65D 43/14; B65D 51/04

[52] U.S. Cl. ..... 220/337; 220/338

[58] Field of Search ..... 220/334, 337, 338

[56] References Cited

U.S. PATENT DOCUMENTS 2,948,430 8/1960 Teague, Jr. et al. ..... 220/338

4,029,234 6/1977 Johnson, Jr. et al. ..... 220/337

*Primary Examiner*—George T. Hall

*Attorney, Agent, or Firm*—Harness, Dickey & Pierce

[57] ABSTRACT

A cooler construction of the type having a pair of cover halves journalled upon a body portion for movement between a closed position and an opened position. An improved pivotal connection is provided for journalling the cover halves and for detachably affixing them to the body portion.

11 Claims, 5 Drawing Figures

PIVOTAL CONSTRUCTION FOR PORTABLE COOLER

BACKGROUND OF THE INVENTION

This invention relates to a pivotal construction for a portable cooler and more particularly to an improved and simplified pivot arrangement for the cover of an insulated cooler.

In insulated coolers such as picnic coolers, the cooler is normally made up of two major components, a body portion that defines the article receiving cavity and a cover for closing the opening that gives access to the cavity. Conventionally, such cooler constructions either employ a detachable cover that may be completely removed from the body portion to obtain access to the articles in the cavity of the body portion or the cover may be connected to the body portion, generally pivotally, and movable relative to it between a closed and opened position. The latter type of coolers have certain advantages for some applications since the cover is part of the total assembly and is not likely to become lost. However, it is important that the pivotal support for the cooler afford relatively unrestricted pivotal movement, should be relatively inexpensive to assemble and also should insure against inadvertent disassembly. Although various pivotal arrangements have been employed, they are relatively complicated, expensive and difficult to assemble and maintain.

It is, therefore, a principal object of this invention to provide an improved portable cooler It is another object of the invention to provide an improved portable cooler arrangement embodying an improved pivotal support for the cover.

It is a further object of this invention to provide an improved and simplified pivotal joint.

DETAILED DESCRIPTION OF THE PREFERRED EMBODIMENT

Figure 1:
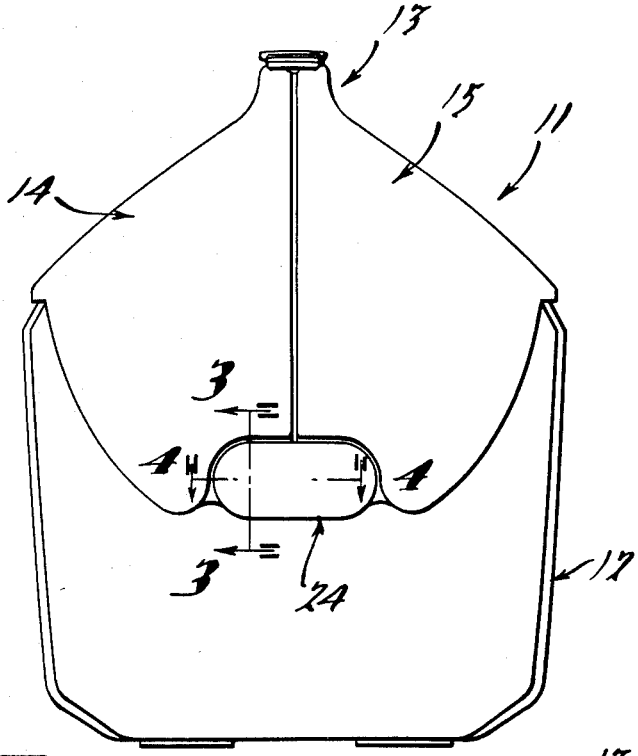
FIG. 1 is an end elevational view of a picnic cooler constructed in accordance with this invention.

In the drawings, the reference numeral 11 indicates generally an insulated picnic cooler constructed in accordance with the invention. The cooler 11 includes a main body portion, indicated generally by the reference numeral 12, in which a cavity is formed so as to contain articles to be stored. The cavity of the main body portion 12 opens through the upper end of the main body portion and is closed by means of a cover assembly, indicated generally by the reference number 13. The cover assembly 13 includes a pair of cover halves 14 and 15 that are pivotally supported at opposite end walls of the body portion 12 for movement between a closed position as shown in the Figures and an opened position where the opening at the upper end of the cavity is exposed so that articles may be taken out of or placed in the cavity. A suitable latch mechanism is employed for locking the cover halves 14 and 15 in their closed position. Since this latch mechanism forms no part of the invention, it has not been illustrated and will not be described any further.

The body portion 12 is formed of a molded plastic of suitable material and is formed with outer and inner walls that define a space between them that may be filled with a suitable insulating material or left void. In a similar manner, the cover halves 14 and 15 are formed from a molded plastic and may be of either a single or double wall material with suitable insulating material disposed between the halves, assuming that a two piece construction is employed. Each cover half 14 and 15 is supported for rotation about a pivot axis that extends longitudinally through the body portion 12 near its center. The structure for providing this pivotal support at each corner of each cover half is the same and, for that reason, only the construction of one pivot point will be described by particular reference to FIGS. 3 through 5 wherein the connection between the cover half 14 and the body portion 12 at one end of the body portion is illustrated.

Figure 3:
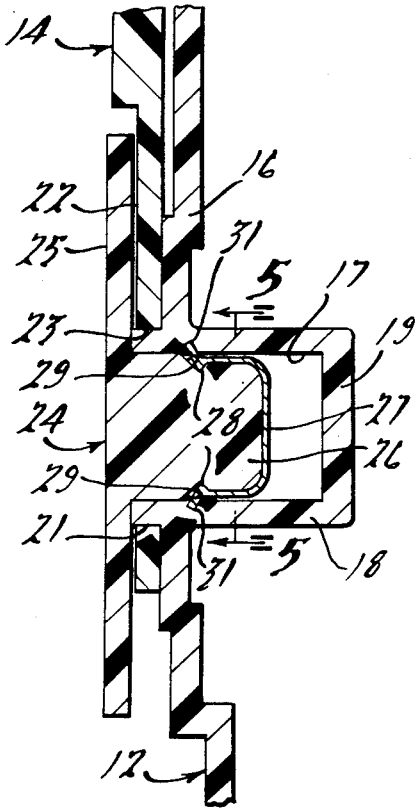
FIG. 3 is an enlarged cross-sectional view taken along the line 3—3 of FIG. 1.
Figure 5:
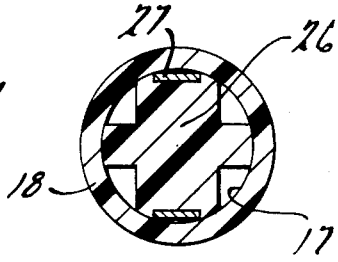
FIG. 5 is a cross-sectional view taken along the line 5—5 of FIG. 3.
Figure 4:
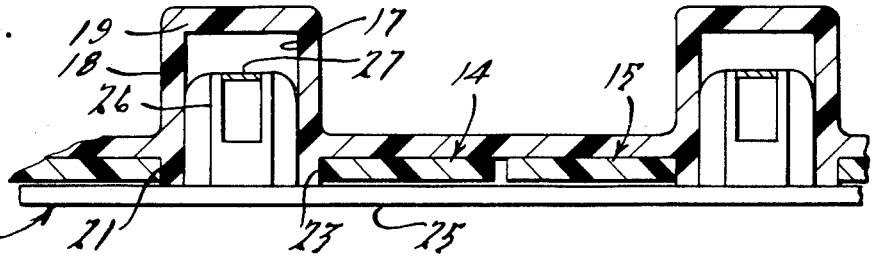
FIG. 4 is an enlarged cross-sectional view taken along the line 4—4 of FIG. 1.

Referring now specifically in FIGS. 3 through 5, the main body portion 12 has its front and rear walls 16 formed with cylindrical openings 17 at each side of the center line. The cylindrical openings 17 are defined by a generally cylindrical wall portion 18 that has its inner end closed by means of an integral wall portion 19. A cylindrical bearing part 21 extends forwardly of the wall 16 for a slight distance and forms a continuation of the cylindrical opening 17. The outer diameter of the bearing portion 21 may be the same as the outer diameter of the portion 18 so as to facilitate molding.

The cover halves 14 and 15 each have inwardly extending walls 22 in which cylindrical openings 23 are formed so as to journal the respective cover halves 14 and 15 on the cylindrical bearing portions 21 of the main body portion 12. The cover half walls 22 have sufficient resilience so as to permit the openings 23 to be snapped onto the bearing surfaces 21 during assembly. The cover halves 14 and 15 are held in assembled relationship to the body portion 12 without restricting their pivotal movement by means of end plate assemblies, indicated generally by the reference numeral 24, at each end of the cooler 11.

Figure 2:
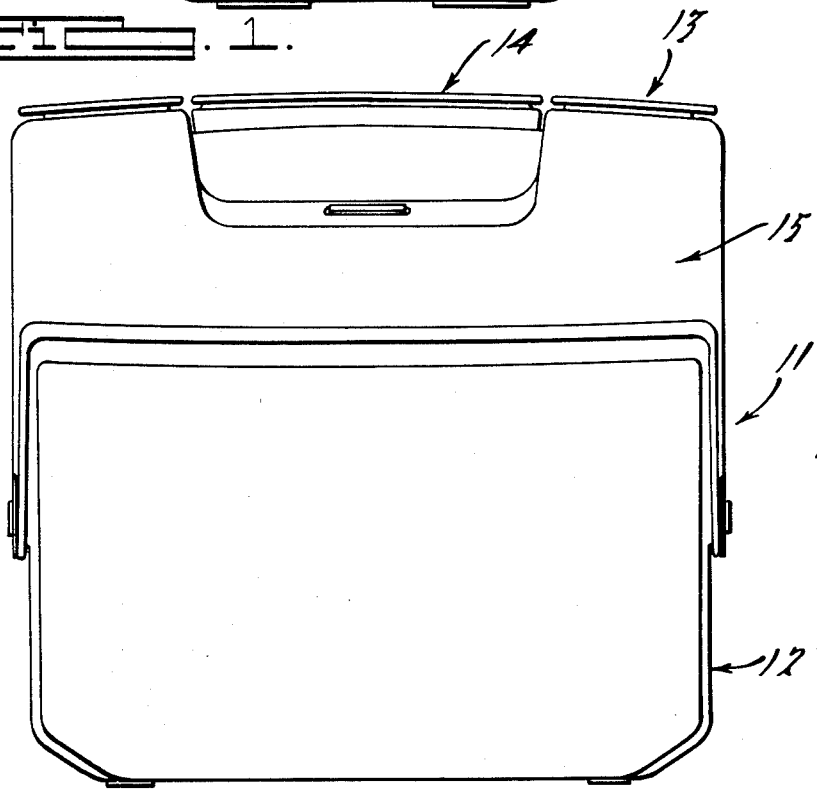
FIG. 2 is a side elevational view of the picnic cooler.

Each end plate assembly 24 is of a molded plastic construction and has a generally oval shaped front plate 24 that extends into the cover half recesses 22 so as to provide a neat and unitary appearance thereto. A pair of generally cruciform shaped projections 26 extend from the rear face of the plate 25 into the cylindrical recesses 17 of the body portion 12. In order to prevent disassembly, spring clips of generally leaf spring configuration 27 are nested in one leg of the cruciform projections 26 and have inwardly extending bight parts 28 that are gripped and received in recesses 29 formed in this leg of the projections 26. The ends of the leaf spring are formed with barb like projections 31 that will be deflected as the assembly consisting of the end plate 24 and leaf springs 27 are inserted into the recesses 17. However, the barbs 31 will grip the walls of the projection 18 and prevent removal of the end plate 24 from the body portion 12. If desired, the openings 17 may be square in shape or have flattened areas adjacent the barbs 31 rather than being cylindrical, so as to increase the area gripped by the barbs 31. Accordingly, the cover halves 14 and 15 are assembled onto and affixed to the body portion 12. As may be readily apparent from an inspection of FIG. 2, the construction is such that the pivotal movement of the cover halves 14 and 15 will not be interferred with.

In view of the foregoing, it should be readily apparent that a relatively simple and yet highly effective arrangement is provided for pivotally connecting the cover halves 14 and 15 to the body portion 12. The construction permits very easy assembly, however, once assembled, it cannot be readily or easily disassembled.

Although an embodiment of the invention has been illustrated and described, it should be readily apparent that various changes and modifications may be made without departing from the spirit and scope of the invention, as defined by the appended claims.

I claim:

1. In a cooler construction having a body portion having an article receiving cavity accessible through an opening, a cover member, and means for supporting said cover member for pivotal movement relative to said body portion for selectively opening and closing said opening, the improvement comprising said means for pivotally supporting said cover member comprising means on said body portion defining a cylindrical recess formed therein and closed at its base by an integral wall, said cover member being formed with an opening therein aligned with the pivot axis of said cover member, and fastening means for connecting said cover member relative to said body member and permitting pivotal movement of said cover member relative to said body member, said fastening means comprising a first piece extending into said cylindrical recess and barb means carried by said first piece for permitting axial entry of said first piece into said cylindrical opening and for precluding withdrawal therefrom.

2. In a cooler construction as set forth in claim 1 wherein the barb means is formed by a spring clip carried by the first piece and detachable relative thereto.

3. In a cooler construction as set forth in claim 2 wherein the first piece comprises a molded plastic member.

4. In a cooler construction as set forth in claim 3 wherein the molded plastic member first piece has a cruciform shape and the spring clip is wrapped around one leg thereof.

5. In a cooler construction as set forth in claim 1 wherein there are a pair of cover members pivotally supported by the body portion and each operative to close a portion of the opening, each of said cover members being pivotally connected to the body portion as defined therein.

6. In a cooler construction as set forth in claim 5 wherein the cover members are pivotally supported at the opposite ends of the body portion.

7. In a cooler construction as set forth in claim 6 wherein the barb means is formed by a spring clip carried by the first piece and detachable relative thereto.

8. In a cooler construction as set forth in claim 7 wherein the first piece comprises a molded plastic member.

9. In a cooler construction as set forth in claim 8 wherein the molded plastic member first piece has a cruciform shape and the spring clip is wrapped around one leg thereof.

10. In a cooler construction as set forth in claim 1 wherein the body member is formed with a cylindrically extending projection surrounding the opening and extending in the opposite direction therefrom, said cover member opening being journalled on said projection.

11. In a cooler construction as set forth in claim 10 wherein the barb means is formed by a spring clip carried by the first piece and detachable relative thereto.

* * * * *